US007549536B2

(12) United States Patent
Pfotenhauer et al.

(10) Patent No.: US 7,549,536 B2
(45) Date of Patent: Jun. 23, 2009

(54) WRAPAROUND PACKAGING

(75) Inventors: Gundolf Pfotenhauer, Napa, CA (US); Jason Curtis, Middletown, CA (US)

(73) Assignee: Francis Coppola Winery LLC, Napa, CA (US)

( * ) Notice: Subject to any disclaimer, the term of this patent is extended or adjusted under 35 U.S.C. 154(b) by 80 days.

(21) Appl. No.: 11/738,231

(22) Filed: Apr. 20, 2007

(65) Prior Publication Data

US 2008/0257761 A1 Oct. 23, 2008

(51) Int. Cl.
*B65D 85/44* (2006.01)

(52) U.S. Cl. ..... 206/426; 206/434

(58) Field of Classification Search ..... 206/175, 206/427, 429, 434, 426; 229/87.01, 87.05, 229/89, 90

See application file for complete search history.

(56) References Cited

U.S. PATENT DOCUMENTS

| | | | | |
|---|---|---|---|---|
| 2,950,041 | A | 8/1960 | Stone | |
| 3,001,647 | A | 9/1961 | Liss | |
| 3,083,825 | A * | 4/1963 | Larsen | 206/434 |
| 3,166,190 | A | 1/1965 | Conrades | |
| 3,598,302 | A * | 8/1971 | Nowak | 206/429 |
| 3,923,236 | A * | 12/1975 | Calvert | 206/434 |
| 4,037,721 | A * | 7/1977 | Schillinger | 206/434 |
| 4,149,636 | A * | 4/1979 | Pintsak et al. | 206/434 |
| 4,196,807 | A | 4/1980 | Brom | |
| 4,407,414 | A * | 10/1983 | Rey et al. | 229/87.01 |
| 4,703,856 | A | 11/1987 | Chaussadas | |
| 5,803,264 | A | 9/1998 | Gersten et al. | |
| 5,845,776 | A | 12/1998 | Galbierz et al. | |
| 5,921,392 | A | 7/1999 | Davis | |
| 6,568,585 | B2 | 5/2003 | Marie | |
| 6,926,147 | B2 | 8/2005 | Holley, Jr. | |
| 7,083,046 | B2 | 8/2006 | Bakx | |
| 7,097,034 | B2 | 8/2006 | Woog | |

* cited by examiner

*Primary Examiner*—Luan K Bui
(74) *Attorney, Agent, or Firm*—McDonnell Boehnen Hulbert & Berghoff LLP

(57) ABSTRACT

A wraparound packaging is provided. The wraparound packaging includes a top portion and a bottom portion, the bottom portion having at least one opening. The packaging further includes a first sidewall attaching the top portion to the bottom portion by a bottom wall, and the length of the bottom wall being smaller than the length of the top portion. A second sidewall extending from the top portion and a first tab extending outwardly from the bottom portion are also included on the packaging. The packaging folds to a final position in which the top portion is located above the bottom portion. The first tab may also include a slit, and the packaging may further include a second tab extending outwardly from the second sidewall for mating with the slit in the first tab.

15 Claims, 4 Drawing Sheets

WRAPAROUND PACKAGING

BACKGROUND

1. Field of the Application

This application relates generally to packaging for articles. More particularly, the application relates to wraparound packaging for single serve plastic wine cups.

2. Description of the Related Art

Food and beverage items are commonly sold as single-serve quantities in individually packaged containers. A variety of different cartons have been designed to package multiple units of these single-serve containers. Normally, these cartons take the form of open-ended wraparound carriers which include openings in the side panels through which a portion of the carton may partially extend.

It has been found desirable by some manufacturers for marketing purposes to package the containers in cartons that allow portions of the containers to be visible from the side as well as from the ends. The packaging must also be strong enough to support the weight of the containers without risk of tearing. Further, the packaging should be relatively easy to assemble and disassemble. Preferably, the packaging should be of a design that permits high speed packaging and uses the smallest amount of material possible to reduce manufacturing costs.

It is therefore desirable to provide a packaging that meets the above specifications.

These as well as other aspects and advantages will become apparent to those of ordinary skill in the art by reading the following detailed description, with reference where appropriate to the accompanying drawings. Further, it should be understood that the embodiments described in this summary and elsewhere are intended to illustrate the invention by way of example only.

SUMMARY

The present application meets the shortcomings of the prior art by providing a wraparound packaging comprising a top portion and a bottom portion, the bottom portion having at least one opening. The packaging further includes a first sidewall attaching the top portion to the bottom portion by a bottom wall, and the length of the bottom wall being smaller than the length of the top portion. A second sidewall extending from the top portion and a first tab extending outwardly from the bottom portion are also included on the packaging. The packaging folds to a final position in which the top portion is located above the bottom portion. The first tab may also include a slit, and the packaging may further include a second tab extending outwardly from the second sidewall for mating with the slit in the first tab.

BRIEF DESCRIPTION OF THE DRAWINGS

Exemplary embodiments of the invention are described herein with reference to the drawings, in which.

DETAILED DESCRIPTION

Figure 1:
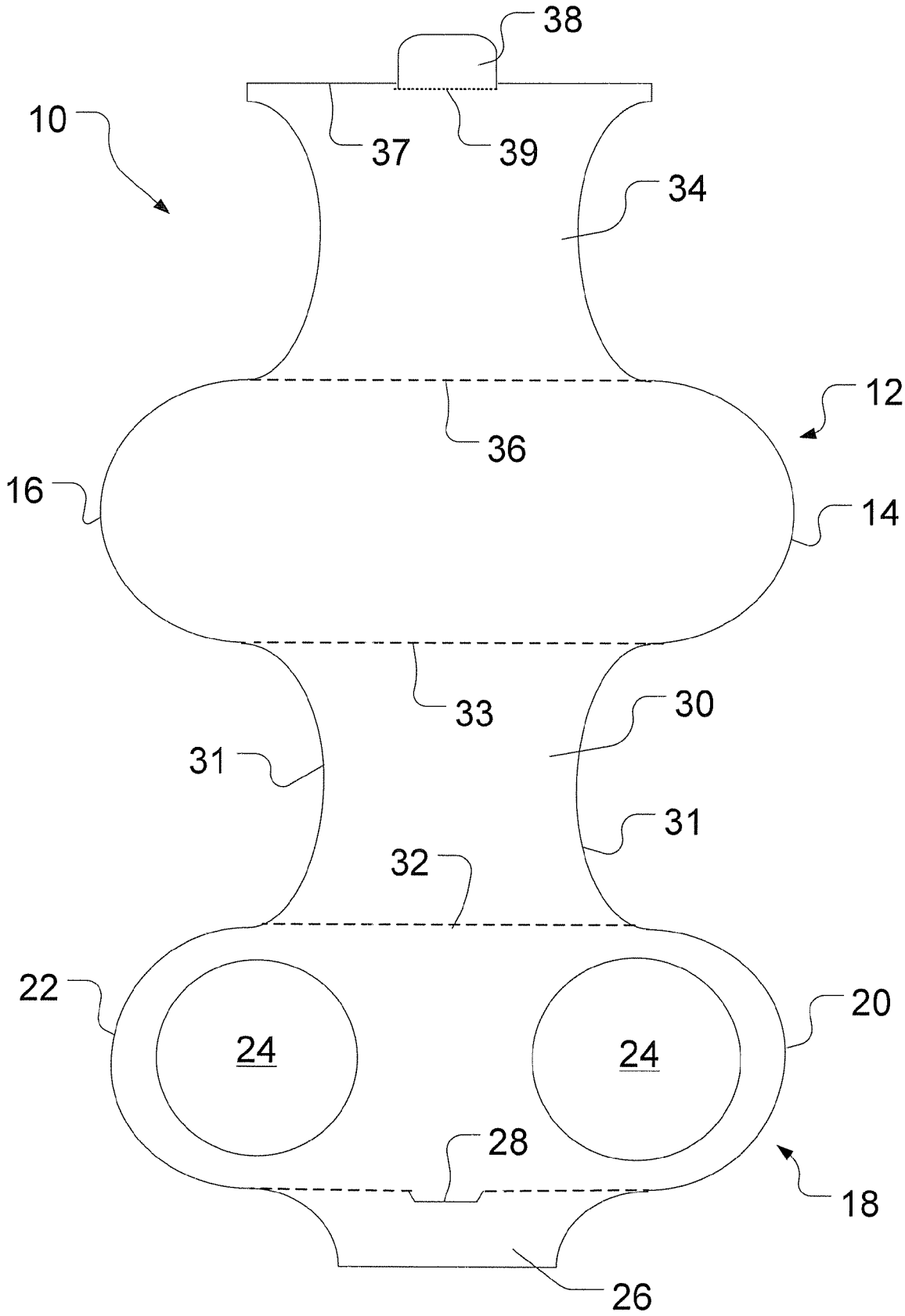
FIG. 1 is a front view of the wraparound packaging of the present invention in an unwrapped position.

A wraparound packaging 10 for at least one container is described herein. The packaging may be constructed of an assortment of materials, such as corrugated material, for example. Referring to FIG. 1, packaging 10 is shown in a flat, unwrapped position. Packaging 10 includes a top portion 12 having a first end 14 and a second end 16. First end 14 and second end 16 may be rounded in shape. However, it should be understood that first end 14 and second end 16 may comprise any variety of shapes.

Packaging 10 further includes a bottom portion 18 having a first end 20 and a second end 22. First end 20 and second end 22 may have the same shape as first end 14 and second end 16 of top portion 12. Thus, first end 20 and second end 22 may be rounded in shape, or alternatively, first end 20 and second end 22 may be any other shape. The outer perimeter of bottom portion 18 may be identical to the outer perimeter of top portion 12.

Figure 3:
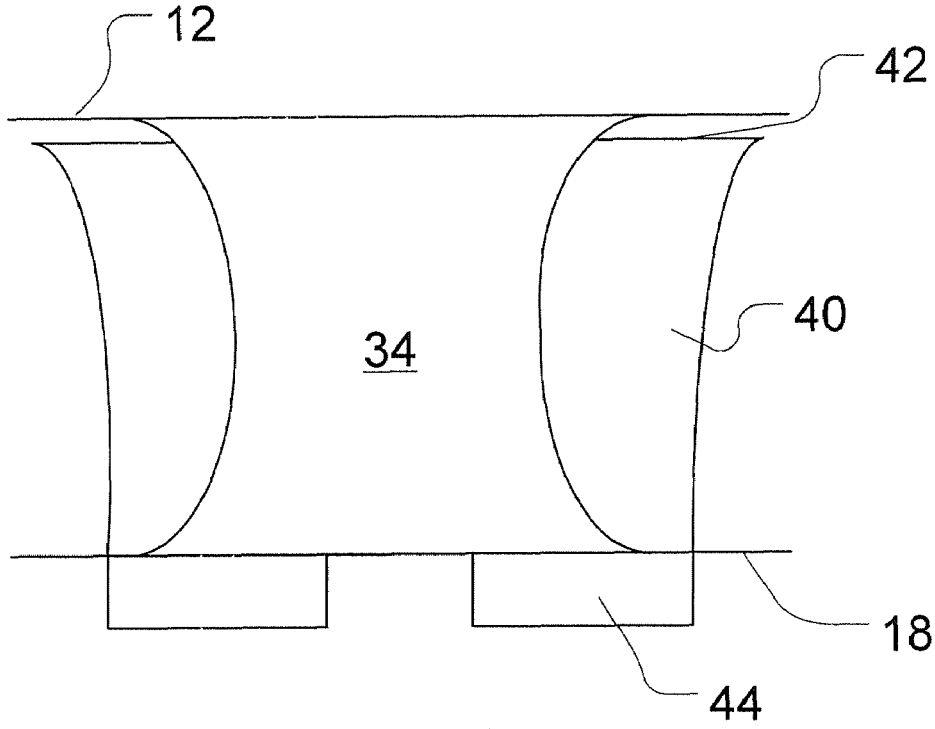
FIG. 3 is a front view of the wraparound packaging shown in FIG. 1 including containers.

Bottom portion 18 further includes at least one opening 24 for accommodating a container 40, which is shown in FIG. 3. Although the at least one opening 24 is shown as a circle in FIG. 1, the opening may comprise any other shape to accommodate a variety of different sizes and shapes of containers.

In a preferred embodiment, bottom portion 18 may include a first tab 26 extending outwardly therefrom. First tab 26 may extend from the outer perimeter of bottom portion 18 in a direction away from top portion 12.

Packaging 10 may further include a slit 28 in a preferred embodiment. Slit 28 may be located at the seam of first tab 26 and the outer perimeter of bottom portion 18.

Packaging 10 further comprises first sidewall 30 attaching top portion 12 to bottom portion 18. Preferably, first sidewall 30 includes at least two curved sides 31. Although sides 31 are shown as being concave, they may alternatively be convex. In another embodiment, the sides 31 of the first sidewall 30 may be any other shape, such as straight, tapered, or zigzag. First sidewall 30 attaches to bottom portion 18 at bottom wall 32. The length of bottom wall 32 may be smaller than the length of bottom portion 18. The first sidewall further attaches to top portion 12 at top wall 33. The length of top wall 33 may be smaller than the length of top portion 12.

Figure 2:
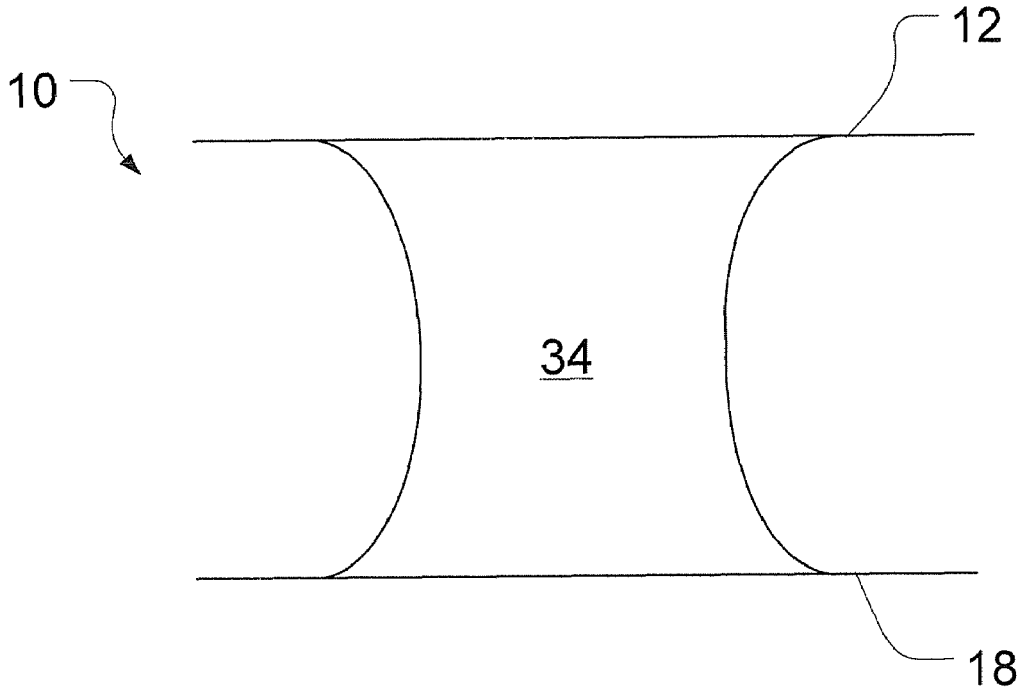
FIG. 2 is a front view of the wraparound packaging shown in FIG. 1 in a wrapped position.

A second sidewall 34 extends outwardly from the outer perimeter of top portion 12 in a direction away from bottom portion 18. Preferably, the shape of second sidewall 34 is a mirror image of the shape of first sidewall 30, such that when packaging 10 is in a wrapped position and viewed from the front or back, only one sidewall is visible, as shown in FIG. 2. Sidewalls 30 and 34 extend only across a portion of the total length of packaging 10 in order to maximize a consumer's ability to see both the packaging and the product it holds.

Second sidewall 34 attaches to top portion 12 at bottom wall 36. The length of bottom wall 36 may be smaller than the length of top portion 12. Preferably, the length of bottom wall 36 is equal to the length of top wall 33 of the first sidewall 30. Second sidewall 34 further includes top wall 37 located opposite from the bottom wall 36. The length of top wall 37 may be smaller than the length of top portion 12. Preferably, the length of top wall 37 is equal to the length of bottom wall 32 of first sidewall 30.

Second sidewall 34 may further include a second tab 38 extending outwardly therefrom. Second tab 38 may extend in a direction away from the top portion 12. Second tab 38 may include a perforation 39 so tab 38 can be easily removed from packaging 10. In a preferred embodiment, second tab 38 engages slit 28 in first tab 26 when packaging 10 is in a wrapped position.

In a preferred embodiment, packaging 10 is made of a corrugated material with the corrugations extending in a direction parallel to the length of top portion 12 and bottom portion 18.

Figure 4:
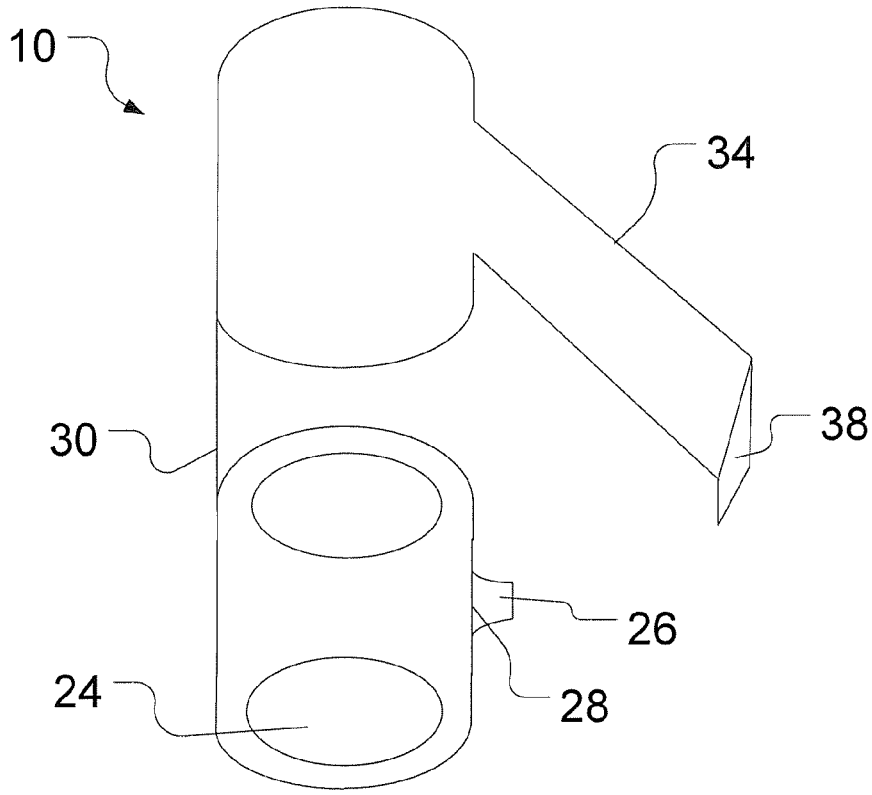
FIG. 4 is a perspective view of the wraparound packaging shown in FIG. 1 being folded to the wrapped position.
Figure 5:
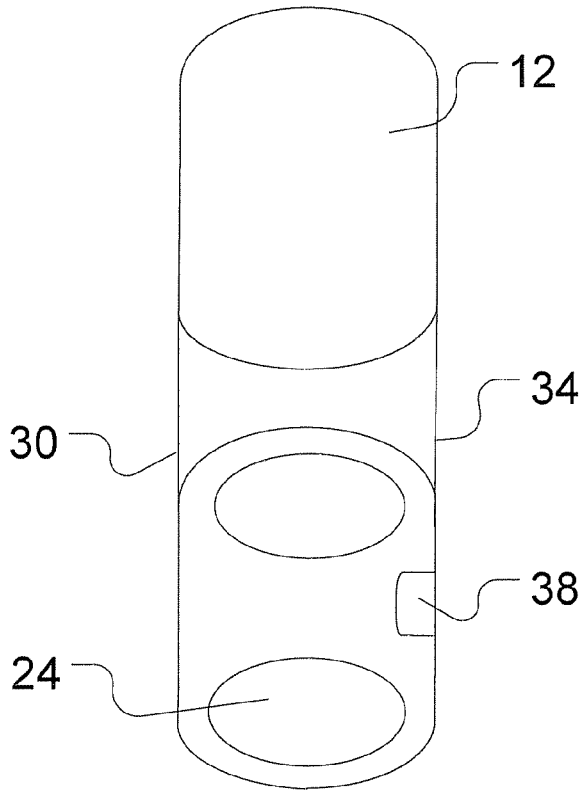
FIG. 5 is a perspective view of the wraparound packaging shown in FIG. 1 in the final wrapped position.

In operation, packaging 10 is placed in an unwrapped position. A user (not shown) then places at least one container 40 into opening 24 in bottom portion 10. Preferably, container 40 may comprise a plastic cup for holding a liquid such as wine, for example. However, one of ordinary skill in the art would appreciate that a variety of containers capable of holding food or liquids may be utilized as container 40. Container 40 may be plastic or glass. Container 40 includes a top surface 42 and a bottom surface 44. Bottom surface 44 of container 40 is positioned into opening 24 such that a portion of bottom surface 44 extends through opening 24. The user then assembles the packaging into the wrapped position by folding first sidewall 30 at bottom wall 32, followed by top wall 33 to position top portion 12 above top surface 42 of container 40. In a preferred embodiment, first tab 26 is folded upward to allow access to slit 28. Second sidewall 34 is then folded at bottom wall 36 around container 40, and held into position by inserting second tab 38 into slit 28, as shown in FIGS. 4 and 5. Second tab 38 then rests against bottom portion 18.

In an alternate embodiment, second sidewall 34 does not include a tab and is directly secured to first tab 26 by glue, tape, fasteners, or any other type of suitable securing means. In yet another embodiment, bottom portion 18 does not include a tab, and second tab 38 is secured directly to bottom portion 18 by glue, tape, fasteners, or any other type of suitable securing means.

Figure 6:
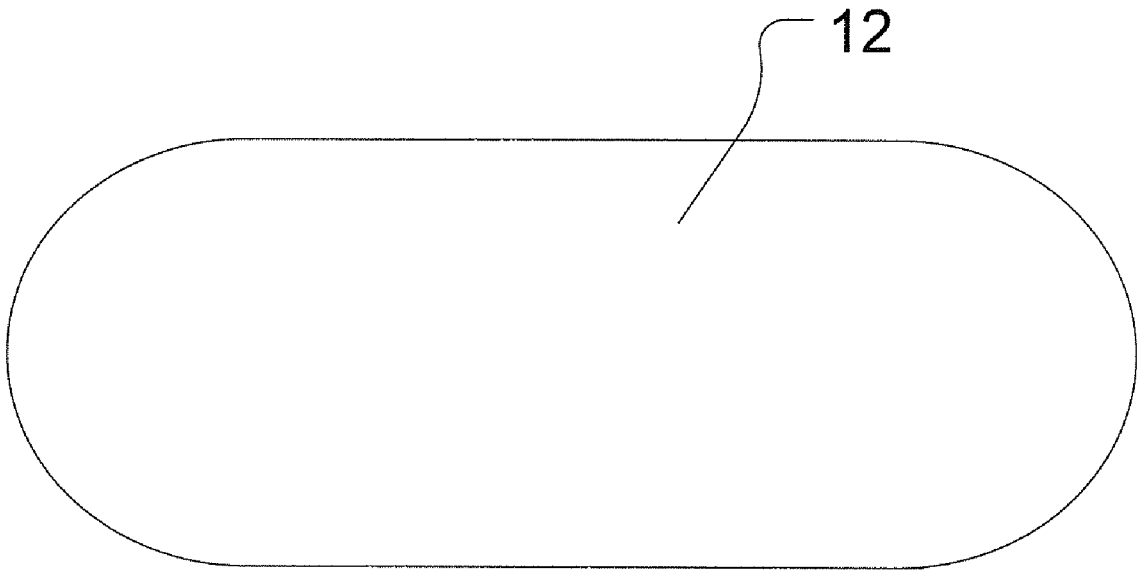
FIG. 6 is a top view of the wraparound packaging shown in FIG. 1.

After second sidewall 34 has been folded and held into position, top surface 42 of container 40 is located within the outer perimeter of top portion 12. Thus, when the packaging is viewed from the top, only top portion 12 of packaging 10 is visible, as illustrated in FIG. 6. Therefore, container 40 is located completely within the outer perimeters of top portion 12 and bottom portion 14.

When opening the packaging 10, a user may simply tear second tab 38 at the perforation 39 for easy access to containers 40.

While certain features and embodiments of the present application have been described in detail herein, it is to be understood that the application encompasses all modifications and enhancements within the scope and spirit of the following claims.

We claim:

1. A wraparound packaging comprising:

a top portion;

a bottom portion, the bottom portion including at least one opening;

a first sidewall attaching the top portion to the bottom portion, the first sidewall attaching to the bottom portion by a bottom wall, and the length of the bottom wall being smaller than the length of the bottom portion;

a second sidewall extending from the top portion;

a first tab extending outwardly from the bottom portion;

a slit located between the bottom portion and the first tab; and a second tab including a perforation and extending outwardly from the second sidewall for mating with the slit in the first tab in the final position;

wherein the packaging folds to a final position, and the top portion is located above the bottom portion in the final position.

2. The packaging of claim 1 wherein the top portion has a first end and a second end, the first end and the second end each having a rounded shape.

3. The packaging of claim 1 wherein the top portion has an outer perimeter and the bottom portion has an outer perimeter that is identical to the outer perimeter of the top portion.

4. The packaging of claim 1 wherein the second sidewall attaches to the top portion by a bottom wall, the length of the bottom wall of the second sidewall being smaller than the length of the top portion.

5. The packaging of claim 1 wherein the first sidewall is a mirror image of the second sidewall.

6. The packaging of claim 1 wherein the first sidewall and the second sidewall each have at least two curved sides.

7. The packaging of claim 1 wherein the packaging is made of a corrugated material, the corrugations being oriented parallel to the length of the top portion.

8. A wraparound packaging for holding at least one container, the packaging comprising:

a top portion, the top portion having an outer perimeter;

a bottom portion, the bottom portion including an outer perimeter and at least one opening for accommodating the at least one container;

a first sidewall attaching the top portion to the bottom portion, the first sidewall attaching to the bottom portion by a bottom wall, and the length of the bottom wall being smaller than the length of the bottom portion;

a second sidewall extending from the top portion;

a first tab extending outwardly from the bottom portion; and the at least one container including a top surface, the top surface being located within the outer perimeter of the top portion wherein the at least one container is located completely within the outer perimeters of the top portion and the bottom portion and wherein the packaging folds to a final position around the at least one container, and the top portion is located above the bottom portion in the final position.

9. The packaging of claim 8 further comprising a slit located between the bottom portion and the first tab, and a second tab extending outwardly from the second sidewall for mating with the slit in the first tab in the final position.

10. The packaging of claim 9 wherein the second tab includes a perforation.

11. The packaging of claim 8 wherein the at least one container is a plastic cup.

12. The packaging of claim 8 wherein a bottom of the at least one container extends through the opening in the bottom portion.

13. The packaging of claim 8 wherein the second sidewall attaches to the top portion by a bottom wall, the length of the bottom wall of the second sidewall being smaller than the length of the top portion.

14. The packaging of claim 8 wherein the first sidewall and the second sidewall each have at least two curved sides.

15. The packaging of claim 8 wherein the packaging is made of a corrugated material, the corrugations being oriented parallel to the length of the top portion.

* * * * *